US005225880A

United States Patent [19]

Shehata et al.

[11] Patent Number: 5,225,880

[45] Date of Patent: Jul. 6, 1993

[54] SYSTEM FOR REMOVING AGGLOMERATES FROM A DEVELOPED IMAGE ON A PHOTORECEPTOR USING A VACUUM

[75] Inventors: Ahmed-Mohsen T. Shehata, Penfield; Bruce J. Parks, Fairport; David J. Lemmon, Hilton; Ahmad Haroon, Pittsford; Hector J. Sanchez, Webster; Richard W. Seyfried, Williamson; Gaith O. Zayed, Rochester; John S. Vouros, Farmington, all of N.Y.

[73] Assignee: Xerox Corporation, Stamford, Conn.

[21] Appl. No.: 757,093

[22] Filed: Sep. 10, 1991

[51] Int. Cl.[5] ..... G03G 21/00

[52] U.S. Cl. ..... 355/296; 15/306.1; 355/215

[58] Field of Search ..... 355/215, 296, 297, 208; 430/125; 118/652; 15/306.1, 375, 418

[56] References Cited

U.S. PATENT DOCUMENTS

| | | | |
|---|---|---|---|
| 4,014,065 | 3/1977 | Hudson | 355/296 X |
| 4,078,929 | 3/1978 | Gondlach | 96/1.2 |
| 4,721,661 | 1/1988 | Olson et al. | 355/296 X |
| 4,797,708 | 1/1989 | Kasiske, Jr. et al. | 355/296 |
| 5,010,367 | 4/1991 | Hays | 355/247 |

*Primary Examiner*—Leo P. Picard
*Assistant Examiner*—Christopher Horgan

[57] ABSTRACT

An agglomerate removal device for removing unwanted particles from images on a photoreceptor includes vacuum pick off source and baffles that create a controlled aerodynamic drag under the photoreceptor before the images reach a transfer station. Removing the agglomerates improves the quality of images transferred at the transfer station to receiving substrates.

11 Claims, 3 Drawing Sheets

SYSTEM FOR REMOVING AGGLOMERATES FROM A DEVELOPED IMAGE ON A PHOTORECEPTOR USING A VACUUM

BACKGROUND OF THE INVENTION

This invention relates generally to the rendering of latent electrostatic images visible using black only or multiple colors of dry toner or developer, and more particularly, to an apparatus that removes agglomerates from developed images, as well as, background areas on a photoreceptor before transfer to paper.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided into three levels, rather than two levels as is the case in conventional xerography. The photoreceptor is charged, typically to 900 volts. It is exposed imagewise, such that one image corresponding to charged image areas (which are subsequently developed by charged-area development, i.e. CAD) stays at the full photoreceptor potential ($V_{cad}$ or $V_{ddp}$). The other image is exposed to discharge the photoreceptor to its residual potential, i.e. $V_{dad}$ or $V_c$ (typically 100 volts) which corresponds to discharged area images that are subsequently developed by discharged-area development (DAD) and the background areas exposed such as to reduce the photoreceptor potential to halfway between the $V_{cad}$ and $V_{dad}$ potentials, (typically 500 volts) and is referred to as $V_{white}$ or $V_w$. The CAD developer is typically biased about 100 volts closer to $V_{cad}$ than $V_{white}$ (about 600 volts), and the DAD developer system is biased about 100 volts closer to $V_{dad}$ than $V_{white}$ (about 400 volts).

The existence of agglomerates and large particles on the photoreceptor developed images of a system such as this causes deletion of part of the image due to reduced transfer of toner around the large particles to paper or other image receiving substrate as the distance between the paper and the toner particles is increased. Thus, a need is created for minimization of agglomerate creation in the developer as well as the picking up of the large particles off the developed image on the photoreceptor. With one color copies, the deletion effects do not aggravate a customer as much as they do in a multi or full color copies where they are extremely visible.

One attempt at reducing this problem is U.S. Pat. No. 4,797,708 that utilizes a vacuum slit close to the photoreceptor as shown in FIG. 1 to pick up the large particles off the photoreceptor by aerodynamic drag as it passes within the vacuum flow. However, this agglomerate removal system suffers from a lack of appropriate air flow under the photoreceptor.

SUMMARY OF THE INVENTION

Accordingly, an apparatus is disclosed that maximizes the rate of agglomerate pick up from developed images on a photoreceptor with minimum image disturbance before transfer to paper which includes a vacuum means with an air inlet port positioned closely adjacent the photoreceptor and an air inlet port downstream thereof with respect to the direction of motion of the photoreceptor. The vacuum means has a portion thereof that extends along and is slanted away from the photoreceptor in order to form a controlled channel flow of air under the photoreceptor and impose flow acceleration on the agglomerates as they get closer to the vacuum port to thereby increase their release and removal from the surface of the photoreceptor.

DESCRIPTION OF THE PREFERRED EMBODIMENT

For a better understanding of the concept of tri-level, highlight color imaging, a description thereof will now be made where $V_O$ is the initial charge level, $V_{ddp}$ the dark discharge potential (unexposed), $V_w$ the white discharge level and $V_c$ the photoreceptor residual potential (full exposure).

Color discrimination in the development of the electrostatic latent image is achieved when passing the photoreceptor through two developer housings in tandem or in a single pass by electrically biasing the housings to voltages which are offset from the background voltage $V_w$, the direction of offset depending on the polarity or sign of toner in the housing. One housing (for the sake of illustration, the second) contains developer with black toner having triboelectric properties such that the toner is driven to the most highly charged ($V_{ddp}$) areas of the latent image by the electrostatic field between the photoreceptor and the development rolls biased at $V_{bb}$ (V black bias). Conversely, the triboelectric charge on the colored toner in the first housing is chosen so that the toner is urged towards parts of the latent image at residual potential, $V_c$ by the electrostatic field existing between the photoreceptor and the development rolls in the first housing at bias voltage $V_{cb}$ (V color bias).

Figure 2:
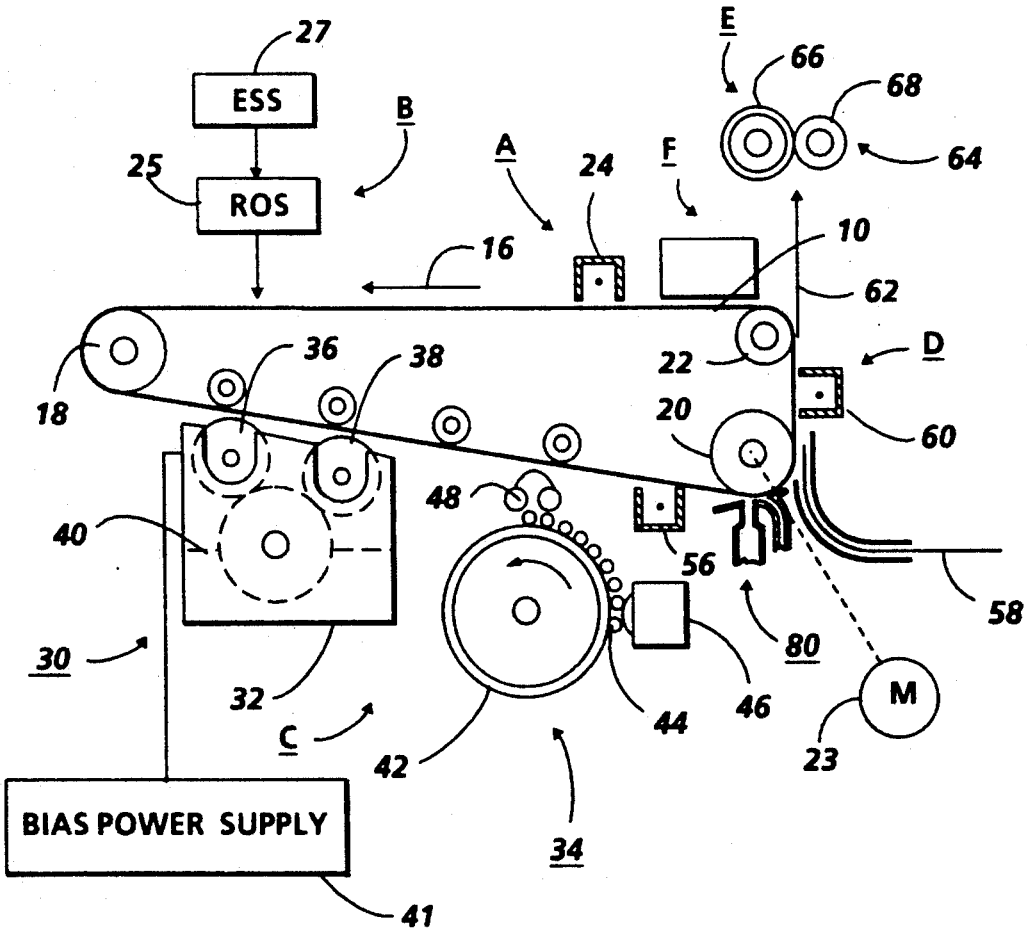
FIG. 2 is a schematic illustration of a printing apparatus incorporating the inventive features of the invention.

As shown in FIG. 2, a highlight color printing machine, as for example in U.S. Pat. No. 5,010,367, in which the invention may be utilized comprises a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22. Roll 20 can be used as a drive roller and roll 18 can be used to provide suitable tensioning of the photoreceptor belt 10. Motor 23 rotates roller 20 to advance belt 10 in the direction of arrow 16. Roller 20 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_O$. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device. An electronic subsystem (ESS) 27 provides for control of the ROS as well as other subassemblies of the machine.

The photoreceptor, which is initially charged to a voltage $V_O$, undergoes dark decay to a level $V_{ddp}$ equal to about −900 volts. When exposed at the exposure station B it is discharged to $V_c$ equal to about −100 volts which is near zero or ground potential in the highlight (i.e. color other than black) color parts of the image. The photoreceptor is also discharged to $V_w$ equal to approximately −500 volts imagewise in the background (white) image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 36 and 38. The rollers advance developer material 40 into contact with the latent images on the charge retentive surface which are at the voltage level $V_c$. The developer material 40 by way of example contains color toner and magnetic carrier beads. Appropriate electrical biasing of the developer housing is accomplished via power supply 41 electrically connected to developer apparatus 32. A DC bias of approximately −400 volts is applied to the rollers 36 and 38 via the power supply 41. With the foregoing bias voltage applied and the color toner suitably charged, discharged area development (DAD) with colored toner is effected.

The second developer apparatus 34 comprises a donor structure in the form of a roller 42. The donor structure 42 conveys developer 44, which in this case is a single component developer comprising black toner deposited thereon via a combination metering and charging device 46, to an area adjacent an electrode structure. The toner metering and charging can also be provided by a two component developer system such as a magnetic brush development structure. The donor structure can be rotated in either the 'with' or 'against' direction vis-a-vis the direction of motion of the charge retentive surface. The donor roller 42 is preferably coated with TEFLON-S (trademark of E.I. DuPont De Nemours) or anodized aluminum.

The developer apparatus 34 further comprises an electrode structure 48 which is disposed in the space between the charge retentive surface 10 and the donor structure 42. The electrode structure is comprised of one or more thin (i.e. 50 to 100 μm diameter) tungsten wires which are positioned closely adjacent the donor structure 42. The distance between the wires and the donor is approximately 25 μm or the thickness of the toner layer on the donor roll. Thus, the wires are self-spaced from the donor structure by the thickness of the toner on the donor structure. For a more detailed description of the foregoing, reference may be had to U.S. Pat. No. 4,868,600 granted to Hays et al on Sep. 19, 1989.

A sheet of support material 58 is moved into contact with the toner image of transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from the stack into a chute which directs the advancing sheet of support material into contact with photoconductive surface of belt 10 in a timed sequence so that the other powder image developed thereon contacts the advancing sheet of support material at transfer station D.

Because the composite image developed on the photoreceptor consists of both positive and negative toner, a negative pre-transfer corona discharge member 56 is provided to condition the toner for effective transfer to a substrate using negative corona discharge.

Transfer station D includes a corona generating device 60 which sprays positive ions onto the backside of sheet 58. This attracts the charged toner powder images from the belt 10 to sheet 58. After transfer, the sheet continues to move, in the direction of arrow 62, onto a conveyor (not shown) which advances the sheet to fusing station E. A detack corona generating device can be placed after transfer corona generating device 60, if desired.

Fusing station E includes a fuser assembly, indicated generally by the reference number 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas of the photoconductive surface are removed therefrom. These particles are removed at cleaning station F. A magnetic brush cleaner housing is disposed at the cleaner station F. The cleaner apparatus comprise a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

The quality of copies may be affected during operation of an electrographic apparatus since some unwanted particles may be deposited onto the photoreceptor before it reaches the transfer station, and removal of these particles is necessary in order to avoid imperfections in the image on the copy sheet. The unwanted particles include, for example, toner agglomerates or agglomerations (sometimes mentioned as toner flakes), particles of carriers from the developer material in two component developer systems, paper dust, or fibers of brushes used for cleaning the photoreceptor. The most troublesome and unwanted particles are those that are present within the image area on the photoreceptor prior to the time the image reaches the transfer station where it is to be transferred to copy paper or other receiving substrate.

Figure 1:
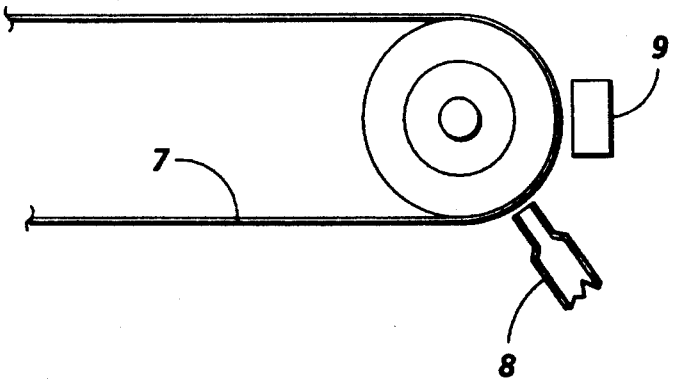
PRIOR ART FIG. 1
FIG. 1 is a schematic elevation view of a portion of an electrographic apparatus incorporating a prior art agglomerate removal vacuum apparatus.

The unwanted particles may be large in comparison to the small individual toner particles which form the developed image, and are sometimes referred to as "tent poles". When the copy paper and the photoconductor are brought into contact or close proximity for transfer of the image, the copy paper in the area around a large unwanted particle or tent pole is held away from the photoconductor by the particle. As a result, some of the small toner particles in the image area around the large particle on the photoconductor do not transfer to the receiver sheet. The effect on the final copy or transfer sheet is an area of low density toner image, sometimes surrounding a black spot when the unwanted particle also transfers to the copy paper. One attempt at removing agglomerates from a photoreceptor 7 is shown in FIG. 1, however, with this device the flow of air due to vacuum source 8 which is positioned before transfer station 9, under the photoreceptor is not efficient. A solution to this problem is shown as 80 in FIG. 2 and comprises a vacuum pick off device that removes unwanted particles from photoreceptor 10 by the use of controlled channel flow underneath the photoreceptor before the transfer station.

Figure 3:
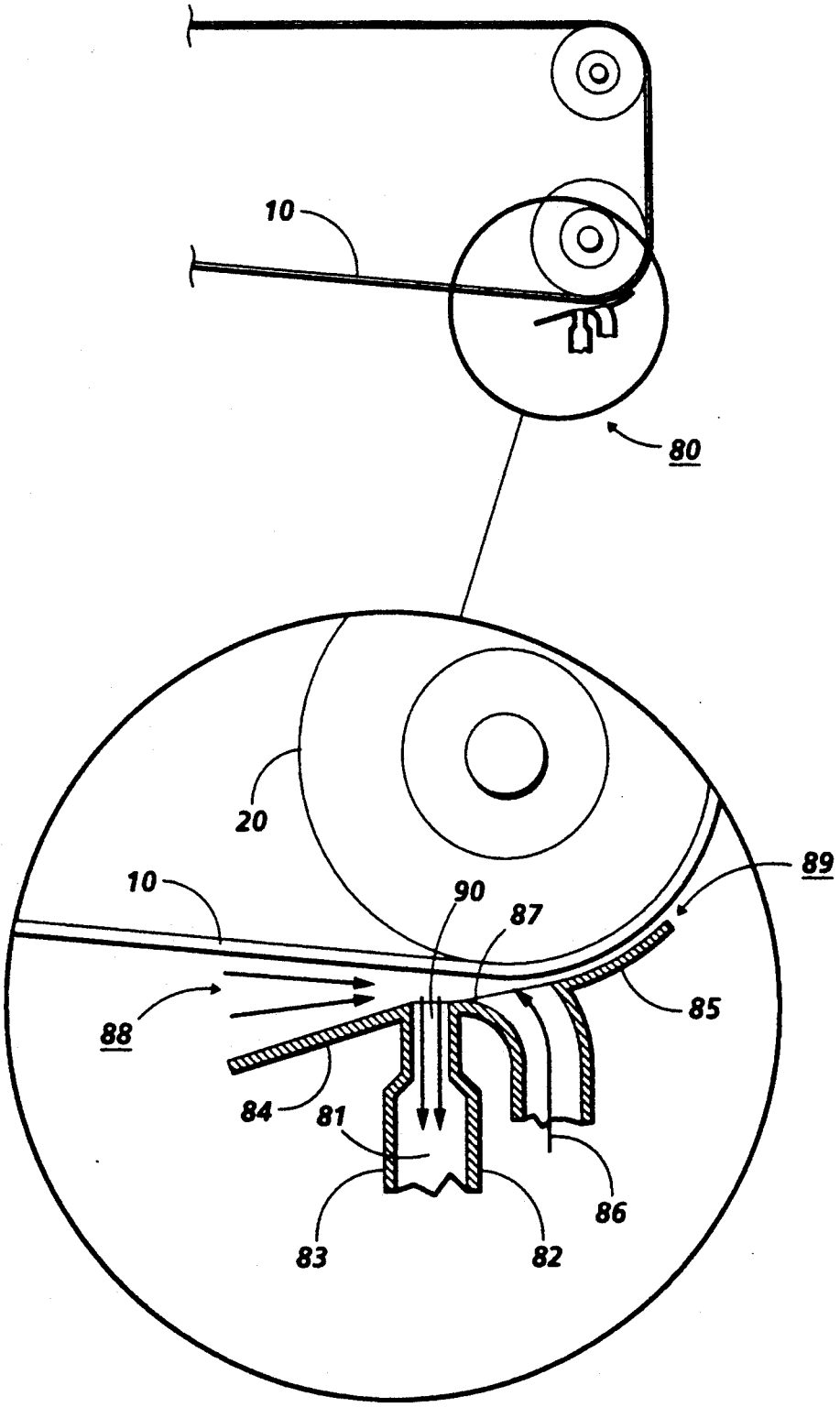
FIG. 3 is a partial, enlarged schematic of the agglomerate removal apparatus of the invention.
Figure 4:
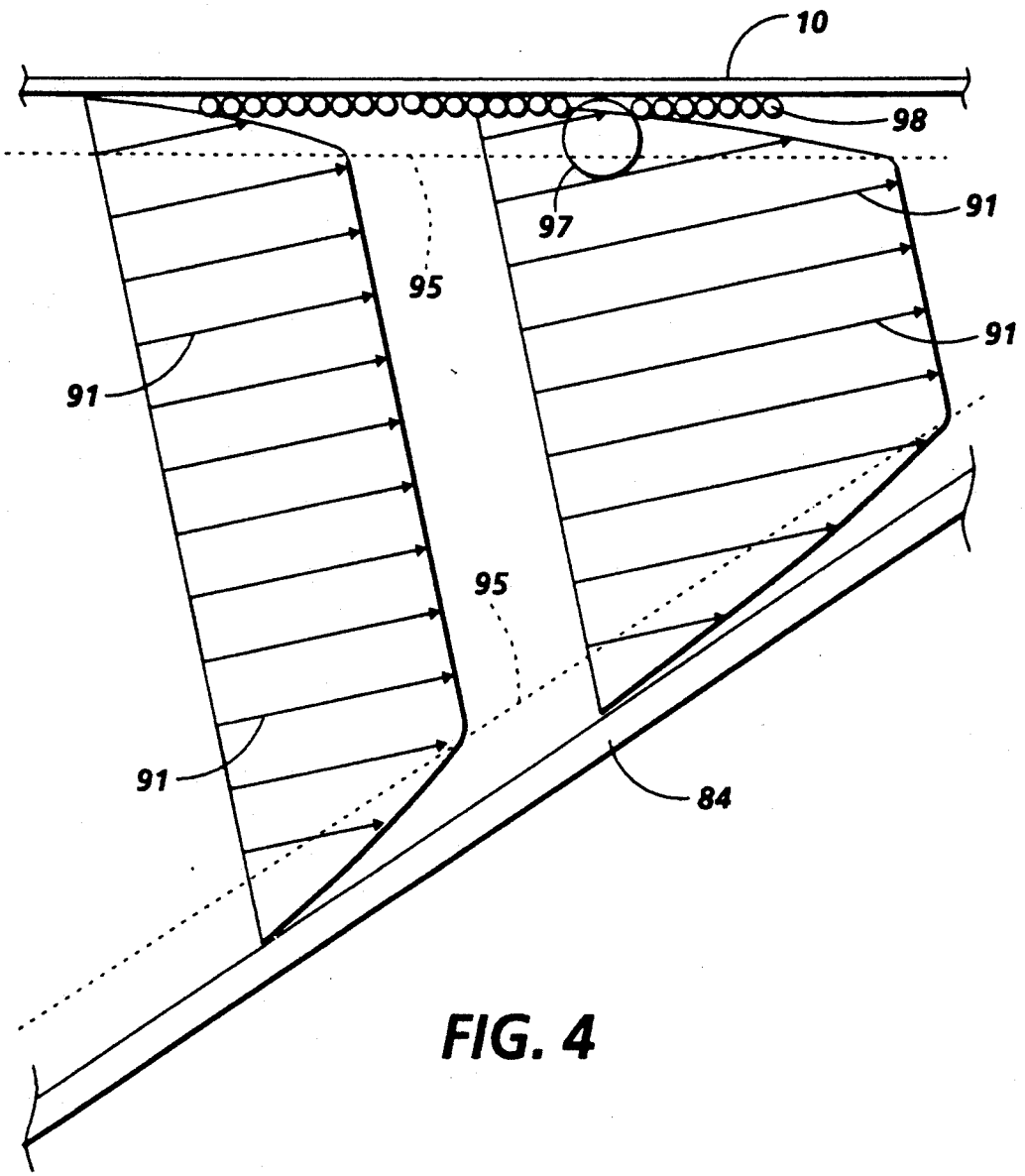
FIG. 4 is a partial, enlarged schematic showing the air flow field and the boundary layers in the air flow control channel of the invention in FIG. 3.

With further reference to vacuum pick off device 80 and FIGS. 3 and 4, an improved and much more controlled channel flow under photoreceptor 10 than can be obtained with the vacuum pick off system of U.S. Pat. No. 4,797,708 is achieved with vacuum manifold 81 that is closely spaced from photoreceptor 10. Vacuum manifold 81 is positioned upstream from transfer station D and adapted to not disturb the image in the transfer area as will be discussed hereinafter. Vacuum manifold 81 comprises side walls 82 and 83, that terminate adjacent to photoreceptor 10 and an air inlet 86 that is downstream from side wall 82. The baffle 85 is positioned closer to the photoreceptor than baffle 84 and the inlet 86. This facilitates the intake of air into vacuum manifold 81 through inlet 88 and 86 rather than 89 which minimizes disturbing the image in transfer station D, thus not disturbing the transfer of images from photoreceptor 10 to copy substrates at the transfer station.

A pair of air flow control channels are included as part of the agglomerate removal device 80 and are comprised of a converging control channel 88 and control channel 89. Converging control channel 88 is formed by the lower surface of photoreceptor 10 and a first baffle portion 84 of manifold 81 that extends to the left of vacuum port 90 as viewed in FIG. 3 and away from photoreceptor 10 in order to provide a much more controlled channel flow under the photoreceptor. The channel flow is configured to impose flow acceleration on large particles as they get closer to the vacuum port. The effects of accelerated flow are that: (1) there will be increased aerodynamic drag on the particles even when they move with the air stream; (2) the boundary layer thickness as shown in FIG. 4 will not thicken out and may actually get thinner which will permit the larger particles to be exposed to the higher velocity and consequently dragged into the air stream; and (3) the air flow will be stabilized to be laminar within the channel and accordingly will have a minimal or no effect on the smaller toner particles on the photoreceptor image. The length of the channel is chosen to guarantee that the boundary layers growing on the channel surfaces will be unconditionally stable. The distances between the photoreceptor and manifold are kept constant to preserve the geometry. A spring (not shown) loads the manifold against a mechanical stop on the housing of drive roll 20.

As seen in FIG. 4, the air flow field created by actuation of vacuum pick off device 80 is indicated by the velocity profile of arrows 91. As a result, a boundary layer of air 95 is created along the surface of photoreceptor 10 and baffle portion 84 of pick off device 80. The boundary layers are laminar like, thereby allowing increased removal of agglomerates 97 from the photoreceptor, leaving toner particles 98 attached to the photoreceptor. Background toner does not have the same electrostatic charge as image toner. The attraction force between the photoreceptor and background toner is usually small. The air flow in the channel will pick up those particles loosely attracted to the photoreceptor.

It should now be understood that an apparatus has been disclosed that removes unwanted particles from the image, as well as, background areas of a photoreceptor without disturbing the image on the photoreceptor. Thus, the image ultimately transferred to the copy substrate is substantially devoid of image imperfections. The apparatus includes a vacuum pick up means that has baffles thereon that form a converging channel along the surface of the photoreceptor. The converging channel provides a desirable controlled channel flow under the photoreceptor and impose flow acceleration on particles as they come closer to a vacuum port in the vacuum pick off means.

This invention has been described in detail with particular reference to a preferred embodiment thereof, but it will be understood that variations and modifications can be effected within the spirit and scope of the invention.

What is claimed is:

1. In a printing apparatus having an endless photoreceptor belt along a path past a series of stations including an imaging station at which a latent image is formed on the photoreceptor, a developing station at which the latent image is developed with toner particles, and a transfer station at which the developed image is transferred to a receiver substrate, the improvement for removing agglomerates from the image areas, as well as, background areas on the photoreceptor, comprising:

a vacuum pick off means including a manifold having a vacuum port through which air can be drawn into the manifold that is closely spaced from the photoreceptor and positioned upstream with respect to the transfer station and adapted to be connected to a negative pressure;

air inlet means positioned downstream from said vacuum port with respect to the direction of rotation of the photoreceptor, said air inlet being operatively connected to and adapted to supply air to said vacuum port without disturbing the image at the transfer station; and converging channel means adapted to provide air flow acceleration under the photoreceptor as agglomerates approach said vacuum port, and wherein said converging channel means includes a first baffle angled away from predetermined positioning of the photoreceptor belt to form a funnel-like configuration with the photoreceptor belt.

2. The improvement of claim 1, wherein said air inlet is connected to an air outlet that is adjacent to and downstream from said vacuum port with respect to the path of the photoreceptor.

3. The improvement of claim 2, wherein said air inlet includes a closely spaced curved second baffle attached thereto that is substantially coplanar with the photoreceptor belt.

4. The improvement of claim 1, wherein said first baffle is connected to said manifold of said vacuum pick off means.

5. The improvement of claim 4, wherein said first baffle has an end thereof attached to said vacuum port of said manifold.

6. In a printing apparatus having an endless photoreceptor belt along a path past a series of stations including an imaging station at which a latent image is formed on the photoreceptor, a developing station at which the latent image is developed with toner particles, and a transfer station at which the developed image is transferred to a receiver substrate, the improvement for removing agglomerates from the image areas, as well as, background areas on the photoreceptor, comprising:

a vacuum pick off means including a manifold having a vacuum port through which air can be drawn into the manifold at a predetermined flow rate that is closely spaced from the photoreceptor and positioned upstream with respect to the transfer station and adapted to be connected to a negative pressure;

converging channel means adapted to provide controlled air flow under the photoreceptor when said vacuum pick off means is activated and impose flow acceleration on the agglomerates as they come increasingly closer to said vacuum port during rotation of the photoreceptor, said converging channel means including a baffle positioned at an acute angle with respect to the plane of the photoreceptor so as to increase the aerodynamic drag along the surface of the photoreceptor on the agglomerates with respect to said predetermined flow rate when they move in the air flow toward said vacuum pick off means and stabilize the air flow to be laminar within said converging channel means in order to have minimum or no effect on smaller agglomerates on the photoreceptor.

7. In a printing apparatus having an endless photoreceptor belt along a path past a series of stations including an imaging station at which a latent image is formed on the photoreceptor, a developing station at which the latent image is developed with toner particles, and a transfer station at which the developed image is transferred to a receiver substrate, the improvement for removing agglomerates from the image areas, as well as, background areas on the photoreceptor, comprising:

a vacuum pick off means including a manifold having a vacuum port through which air can be drawn into the manifold at a predetermined flow rate that is closely spaced from the photoreceptor and positioned upstream with respect to the transfer station and adapted to be connected to a negative pressure;

converging channel means adapted to provide controlled air flow under the photoreceptor when said vacuum pick off means is activated and impose flow acceleration on the agglomerates as they come increasingly closer to said vacuum port during rotation of the photoreceptor, said converging channel means including a baffle positioned at an acute angle with respect to the plane of the photoreceptor so as to increase the aerodynamic drag along the surface of the photoreceptor on the agglomerates with respect to said predetermined flow rate when they move in the air flow toward said vacuum pick off means and stabilize the air flow to be laminar within said converging channel means in order to have minimum or no effect on smaller agglomerates on the photoreceptor; and air inlet means positioned downstream from said vacuum port with respect to the direction of rotation of the photoreceptor, said air inlet being operatively connected to and adapted to supply air to said vacuum port without disturbing the image at the transfer station.

8. The improvement of claim 7, wherein said air inlet means is connected to an air outlet adjacent to the photoreceptor belt.

9. An apparatus for removing agglomerates from the image areas, as well as, background areas on a photoreceptor, comprising:

a vacuum pick off means including a manifold having a vacuum port through which air can be drawn into the manifold at a predetermined flow rate that is closely spaced from the photoreceptor and positioned upstream with respect to a transfer station and adapted to be connected to a negative pressure; and converging channel means adapted to provide accelerated air flow under the photoreceptor when said vacuum pick off means is activated, and wherein said converging channel means comprises a baffle that is configured with respect to the photoreceptor to increase the aerodynamic drag along the surface of the photoreceptor relative to said predetermined flow rate on the agglomerates when they move in the air flow toward said vacuum pick off means, stabilize the air flow to be laminar within said converging channel means in order to have minimum or no effect on smaller agglomerates on the photoreceptor and impose flow acceleration on the agglomerates as they approach said vacuum port.

10. The apparatus of claim 9, wherein said baffle is positioned at an acute angle with respect to the plane of the photoreceptor.

11. In an electrographic apparatus having an endless photoreceptor belt along a path past a series of stations including an imaging station at which a latent image is formed on the photoreceptor, a developing station at which the latent image is developed with toner particles, and a transfer station at which the developed image is transferred to a receiver substrate, the improvement for removing agglomerates from the image areas, as well as, background areas on the photoreceptor, comprising:

a vacuum pick off means including a manifold having a vacuum port through which air can be drawn into the manifold that is closely spaced from the photoreceptor and positioned upstream with respect to the transfer station and adapted to be connected to a negative pressure;

air inlet means positioned downstream from said vacuum port with respect to the direction of rotation of the photoreceptor, said air inlet being operatively connected to and adapted to supply air to said vacuum port without disturbing the image at the transfer station; and converging channel means adapted to provide controlled air flow under the photoreceptor when said vacuum pick off means is activated, and wherein said converging channel means comprises a baffle that is configured with respect to the photoreceptor to impose flow acceleration on the agglomerates as they approach said vacuum port.

* * * * *